United States Patent [19]

Matsuda et al.

[11] 4,198,550

[45] Apr. 15, 1980

[54] PERIPHERALLY REINFORCED LAMINATED LOUDSPEAKER DIAPHRAGM

[75] Inventors: Atsushi Matsuda, Tokyo; Jun Kishigami, Urawa; Masaaki Nishimura, Tokyo, all of Japan

[73] Assignee: Sony Corporation, Tokyo, Japan

[21] Appl. No.: 963,902

[22] Filed: Nov. 27, 1978

[30] Foreign Application Priority Data

Nov. 26, 1977 [JP] Japan ..... 52-158845[U]

[51] Int. Cl.[2] ..... H04R 7/10; H04R 7/18

[52] U.S. Cl. ..... 179/181 F; 179/181R; 181/167; 181/170; 181/171

[58] Field of Search ..... 179/115.5 R, 181 R, 179/181 F; 181/DIG. 1, 167, 168, 169, 170, 171, 172

[56] References Cited

U.S. PATENT DOCUMENTS 3,111,187 11/1963 Barlow ..... 179/181 F 4,122,314 10/1978 Matsuda et al. ..... 179/115.5 R

*Primary Examiner*—George G. Stellar

*Attorney, Agent, or Firm*—Lewis H. Eslinger; Alvin Sinderbrand

[57] ABSTRACT

A diaphragm for a loudspeaker includes first and second sheet members between which a core member is sandwiched and secured so that the core member has peripheral edge portions extending between the edges of the sheet members and at which the core member is of relatively low strength. A strip-like edging member, preferably of a thermosetting resin, is secured to the peripheral edge portions of the core member and to the edges of the sheet members for increasing the rigidity of the diaphragm at its periphery and preventing unwanted vibrations thereat. A damper member may be secured to the diaphragm adjacent the edging member for movably securing the diaphragm to a loudspeaker frame.

11 Claims, 8 Drawing Figures

PERIPHERALLY REINFORCED LAMINATED LOUDSPEAKER DIAPHRAGM

BACKGROUND OF THE INVENTION

1. Field of the Invention

The present invention relates generally to loudspeakers, and more particularly is directed to an improved diaphragm for a loudspeaker.

2. Description of the Prior Art

It is well known, in the art of loudspeaker design, to provide a diaphragm which is vibrated by a magnetic means having varying electrical signals supplied thereto. The design of a diaphragm for a loudspeaker must take into account numerous considerations among which are the configuration of the loudspeaker and the desired vibratory characteristics of the diaphragm. A failure to take into account any one of these essential considerations could lead to a loudspeaker having deleterious acoustic characteristics.

An important consideration that must be taken into account in designing a diaphragm for a loudspeaker is reducing the weight or mass thereof while ensuring that the diaphragm can structurally withstand the vibratory motion imparted thereto. In furtherance of the foregoing, one prior art diaphragm for a loudspeaker is in the form of a lamination which includes a core member sandwiched between a pair of sheets. The core member is typically of a styrene foam material or of an aluminum material in the form of a honeycomb structure. However, because peripheral edge portions of the core member extending between the sheet members are not rigidified by the latter, unstable vibrations are produced thereat when the diaphragm is caused to vibrate by the magnetic means. In the case of the aluminum honeycomb core member, these unstable vibrations result in extraneous noise and a consequent degenerative acoustic quality of the loudspeaker. In the case where the core member is of a styrene foam material, the vibrations at the peripheral edge of the core member tend to cause the styrene foam material thereat to crumble or disintegrate.

One prior art attempt to solve these problems has been to employ an adhesive agent for filling gaps or depressions in the peripheral edge of the core member. However, this method, especially when employed in the case of the aluminum honeycomb core member, has proved to be undesirable because the adhesive agent causes a substantial increase in the mass or weight of the diaphragm, resulting in a deterioration of the desirable audio characteristics of the loudspeaker.

OBJECTS AND SUMMARY OF THE INVENTION

It is, therefore, a principal object of the present invention to provide a diaphragm for a loudspeaker which is of low mass, and in which the peripheral edge thereof has an increased rigidity and is resistant to undesirable vibrations thereat.

Another object of the invention is to provide a diaphragm for a loudspeaker which includes a light weight core member sandwiched between sheet members, and in which the periphery of the core member of the diaphragm is desirably reinforced for increasing the rigidity of and preventing unwanted vibrations at the peripheral edge portions of the core member.

It is still another object of the invention to provide a diaphragm for a loudspeaker, as aforesaid, and in which the rigidity of the peripheral edge of the diaphragm is substantially increased for preventing unwanted vibrations thereat without substantially increasing the weight of the diaphragm.

In accordance with an aspect of the invention, a diaphragm for a loudspeaker includes first and second sheet members between which a core member is sandwiched and secured so that the core member has a peripheral edge portion extending between edges of the sheet members and at which the core member is of relatively low strength, and a strip-like edging member, preferably of a thermosetting resin, is secured to the peripheral edge portions of the core member and to the adjacent edges of the sheet members for increasing the rigidity of the diaphragm at its periphery and preventing unwanted vibrations thereat. A damper member may be secured to the diaphragm adjacent the edging member for movably securing the diaphragm to a loudspeaker frame.

The above, and other, objects, features and advantages of the present invention, will be apparent from the following detailed description which is to be read in connection with the accompanying drawings.

DESCRIPTION OF THE PREFERRED EMBODIMENTS

Figure 1:
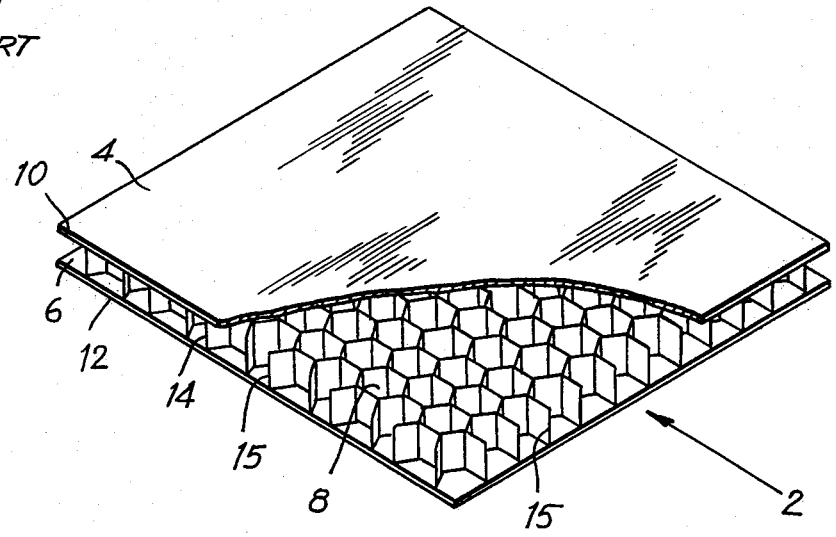
FIG. 1 PRIOR ART
FIG. 1 is a perspective view, which is partially broken away, and which shows a prior art diaphragm for a loudspeaker, upon which the present invention is an improvement.

Referring to the drawings in detail and initially to FIG. 1 thereof, it will be seen that a prior art diaphragm 2 for a loudspeaker includes first and second sheet members 4 and 6, respectively, and a core member 8 sandwiched between sheet members 4 and 6, and secured thereto by any suitable means, such as an adhesive. Core member 8 may be made from any structurally sufficient and lightweight material, such as, the honeycomb box-like structure, preferably of aluminum sheet material, shown on FIG. 1. The first and second sheet members 4 and 6, which are preferably of sheet aluminum or carbon fiber material, are secured to opposite sides of core member 8 and are substantially coextensive with the latter so that edge portions 14 of core member 8 are exposed or unsupported between edges 10 and 12 of sheet members 4 and 6. Such exposed edge portions of core member 8, when the latter is in the form of a honeycomb structure, are constituted by trimmed edge sections 15 of such structure.

As a result, vibration of diaphragm 2 in a loudspeaker gives rise to the previously discussed problems, that is, unwanted or extraneous vibrations at the peripheral edge portions 14 of core member 8, particularly in the case of the aluminum honeycomb structure, resulting in poor sound generating characteristics. In the case where the core member of the prior art diaphragm is formed of styrene foam material, instead of the illustrated honeycomb structure, crumbling may occur at the peripheral edge portions 14 of the styrene foam material, resulting in a degradation of the acoustic characteristics of the loudspeaker.

Figure 2:
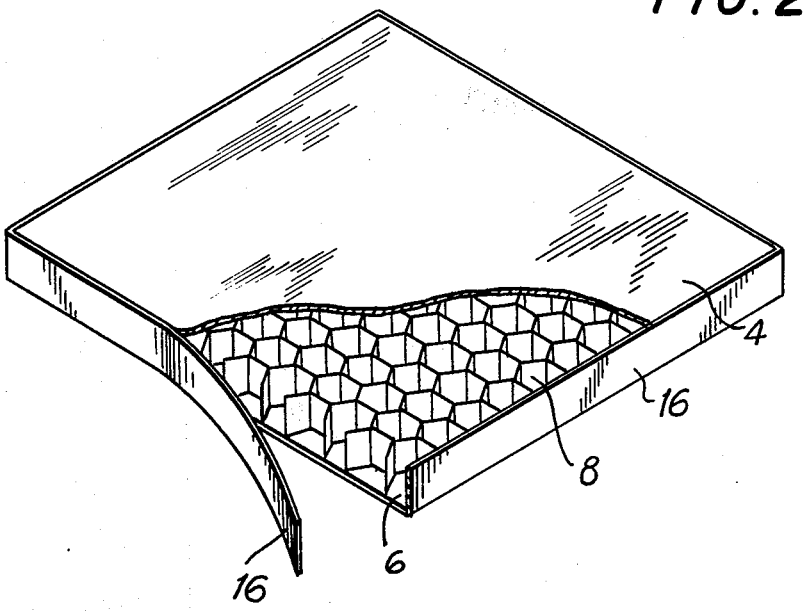
FIG. 2 is a perspective view similar to FIG. 1, but showing one embodiment of a diaphragm for a loudspeaker in accordance with the present invention.
Figure 3:
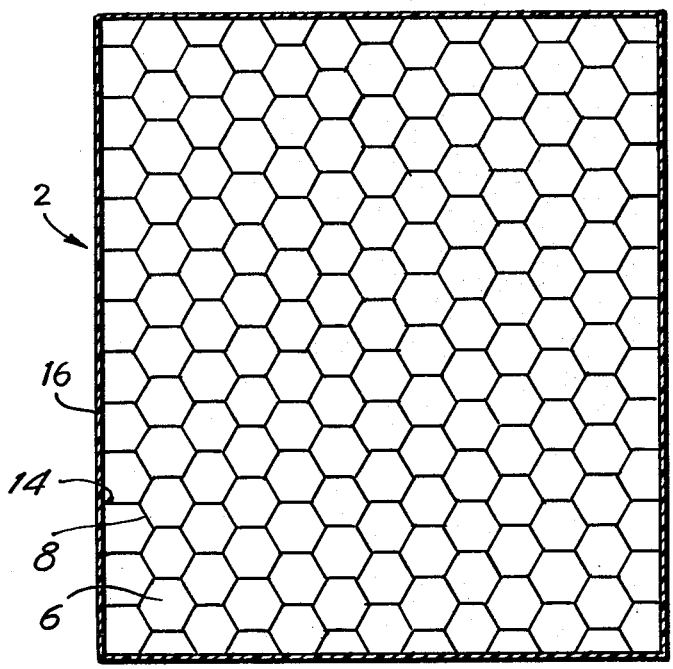
FIG. 3 is a top plan view of the diaphragm of FIG. 2, but from which an upper sheet member has been removed.

Referring now to FIGS. 2 and 3, it will be seen that a diaphragm according to the present invention again includes a core member 8 sandwiched between first and second sheet members 4 and 6 and secured thereto by any suitable means, such as an adhesive. However, in accordance with the invention, a strip-like edging member 16 is secured to peripheral edge portions 14 of core member 8 and to edges 10 and 12 of sheet members 4 and 6, respectively, for increasing the rigidity of the diaphragm at its periphery and preventing unwanted vibrations thereat. Edging member 16 may be made from any suitable material, but preferably is of a thermosetting resin, for example, the B stage epoxy sheet material available commercially under the tradename "FIBREDUX 609", from Ciba-Geigy Corp., and which adheres to peripheral edges 10 and 12 and peripheral edge portions 14 and hardens upon the application of heat and pressure thereto. It is to be noted that edging member 16 may be made from any other suitable lightweight material such as paper, cloth, plastic film, aluminum foil, or the like, and which is secured to edges 10 and 12 and peripheral edge portions 14 by any suitable means, such as, an adhesive. As a result, the trimmed end sections 15 of the honeycomb structure of core member 8 are secured along the end edges thereof to prevent unwanted vibrations thereat and for increasing the rigidity of diaphragm 2 at its periphery. Similarly, as shown on FIG. 4, in a diaphragm 2' according to another embodiment of this invention, an edging member 16 on a core member 8' made from a styrene foam material prevents crumbling of the styrene foam material at the periphery thereof. It can be readily seen that no substantial increase in weight of the diaphragm occurs with the addition of edging member 16.

Figure 4:
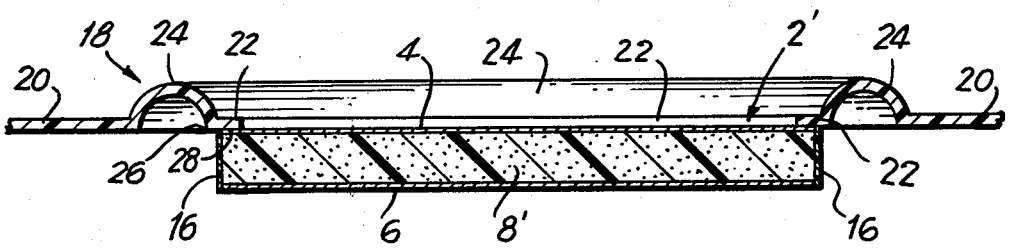
FIG. 4 is a cross-sectional view of a diaphragm of the present invention according to another embodiment and which is shown attached to a damper member.

As further shown on FIG. 4, a damper member 18 may be provided for movably securing diaphragm 2' according to the present invention to a loudspeaker frame. Damper member 18 includes a first or outer flange-like section 20 adapted to be secured to a loudspeaker frame, a second or inner flange-like section 22 adapted to be secured to diaphragm 2' and a flexible connecting or intermediate section 24 extending between the first and second sections 20 and 22, respectively. In the embodiment shown on FIG. 4, first and second sections 20 and 22, respectively, are of a substantially planar configuration and are substantially co-planar with each other. Second section 22 has an outer edge 26 of substantially similar dimension to peripheral edge 10 of sheet member 4 and is secured, as by adhesive, at its bottom surface 28 of the outer surface of first sheet member 4 adjacent the edge of the latter. Flexible connecting section 24 of damper member 18 is integrally attached, at its outer and inner margins, to the adjacent edges of first and second planar sections 20 and 22, respectively, and is of bowed or generally U-shaped cross-sectional configuration. Of course, damper member 18 has a plan configuration similar to that of the periphery of diaphragm 2', so that, if diaphragm 2' is rectangular or square as shown on FIGS. 2 and 3, damper member 18 will be similarly rectangular or square, respectively. Damper member 18 may be made from any suitable elastomeric or flexible material such as a urethane resin, rubber, leather, cloth or paper with an internal ribbed structure, or the like, such that damper member 18 permits diaphragm 2' to vibrate within the loudspeaker frame.

Figure 5:
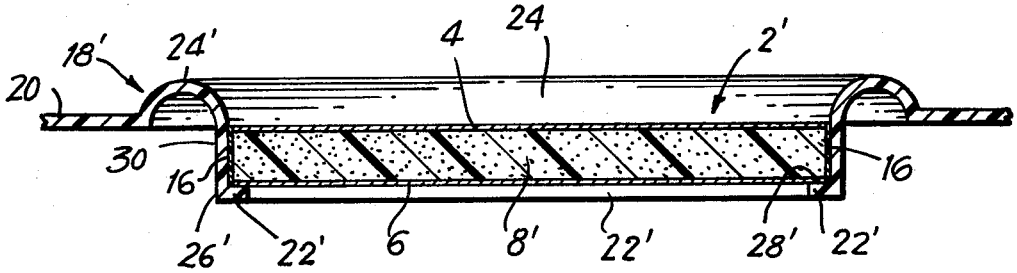
FIG. 5 is a cross-sectional view similar to FIG. 4, but showing the diaphragm attached to another form of damper member.

Referring now to FIG. 5, another embodiment of a damper member 18' is shown to include a first planar section 20 adapted to be secured to a loudspeaker frame, a second planar section 22' adapted to be secured to diaphragm 2' and being parallel, are offset in respect to first section 20, and a flexible connecting section extending between the first and second sections 20 and 22', respectively. As described previously in regard to second section 22 in FIG. 4, the outer edge 26' of second section 22' is of substantially similar dimension to peripheral edge 12 of second sheet member 6 and is secured at its upper surface 28' to the peripheral bottom surface of second sheet member 6. Flexible connecting section 24' has a generally U-shaped cross-sectional configuration with one of the legs 30 thereof being longer than the other leg and in facially abutting relation to strip-like edging member 16 of diaphragm 2'. Leg 30 of flexible connecting section 24' may be attached to strip-like edging member 16 by any suitable means, such as, an adhesive. However, in the case where edging member 16 is of a thermosetting resin, leg 30 is preferably placed in contact with edging member 16 while heat is applied thereto to simultaneously secure edging member 16 to edges 10 and 12, peripheral edge portions 14 and leg 30 portion of flexible connecting section 24'.

Figure 6:
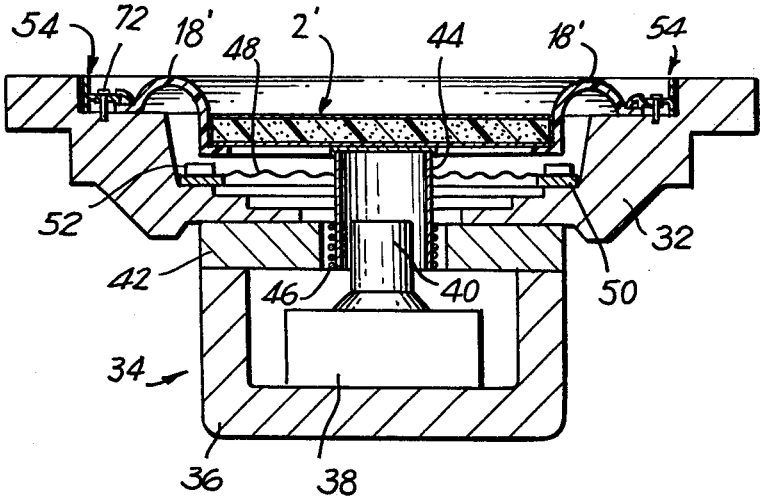
FIG. 6 is a cross-sectional view of a loudspeaker including the diaphragm of FIG. 5.

Referring now to FIG. 6, a loudspeaker is there shown to include a loudspeaker frame 32, the diaphragm 2' according to the present invention movably secured to frame 32, and a magnetic means 34 for vibrating diaphragm 2' in accordance with varying electrical signals supplied thereto. Magnetic means 34 may conventionally include a cup-shaped magnetic yoke 36, a permanent magnet 38 located within yoke 36, a pole piece 40 disposed on and connected to magnet 38, and an annular yoke plate 42 extending radially inward from the rim of yoke 36 about pole piece 40 while leaving an air gap therebetween. A coil bobbin 44 is secured at one end to a surface of diaphragm 2', and more particularly to the sheet member 6 thereof, and at its opposite end, bobbin 44 surrounds pole piece 40 within the air gap between the latter and yoke plate 42. A voice coil 46 is wound on bobbin 44 within the air gap between bobbin 44 and yoke plate 42. Bobbin 44 is also shown to be supported intermediate its ends by a bobbin damper 48 having a damper ring 50 at its outer periphery which is attached to fame 32 by means of screws or bolts 52.

Figure 7:
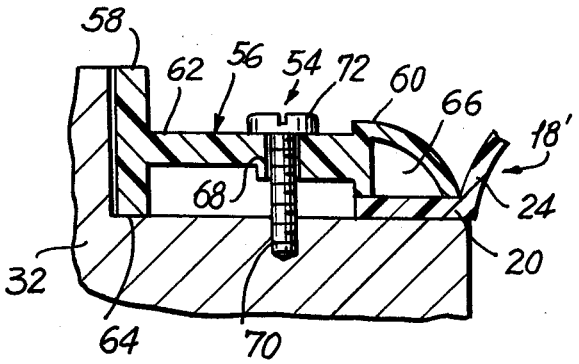
FIG. 7 is an enlarged detail sectional view illustrating a preferred arrangement for attaching the diaphragm to a loudspeaker frame.

As shown generally on FIG. 6 and in greater detail on FIG. 7, damper member 18 is preferably secured to frame 32 of the loudspeaker by damper securing means 54 which includes a pressure member or clamp 56 having a first portion or foot 58 adapted to bear against and be supported by frame 32, a second portion or nose 60 adapted to press section 20 of damper member 18' against frame 32, and a connecting portion 62 spanning or extending between the first and second portions 58 and 60, respectively. First portion 58 of pressure member 56, is shown to be of a substantially flat, rectangular cross-sectional configuration and situated substantially perpendicular to connecting portion 62 so that one end 64 of first portion 58 abuts against frame 32. Second or nose portion 60 of pressure member 56 has a cavity 66 opening toward section or flange 20 so that, when nose portion 60 is pressed against flange 20 to compress the latter at the area of contact, the flange 20 can expand into cavity 66 and thereby increase the security of its engagement by pressure member 56. Connecting portion 62 has an aperture 68 therein through which a screw or bolt 72 is passed for threadable engagement in a tapped hole 70 in frame 32. In this manner, as shown in FIG. 7, with flange or section 20 of damper member 18' abutting frame 32, pressure member 56 may be tightened against frame 32 by means of screw or bolt 72 to clamp flange 20 of damper member 18' against frame 32. In this regard, it will be appreciated that, by reason of the described configuration of pressure member 56, tightening of screw 72 causes a pivoting of member 56 about edge 64 of its foot portion 58 and provides a mechanical advantage or accentuated force of nose portion 60 against flange portion 20. Because of the inherent resiliency of pressure member 56, a secure clamping of damper member 18' to frame 32 is achieved.

Figure 8:
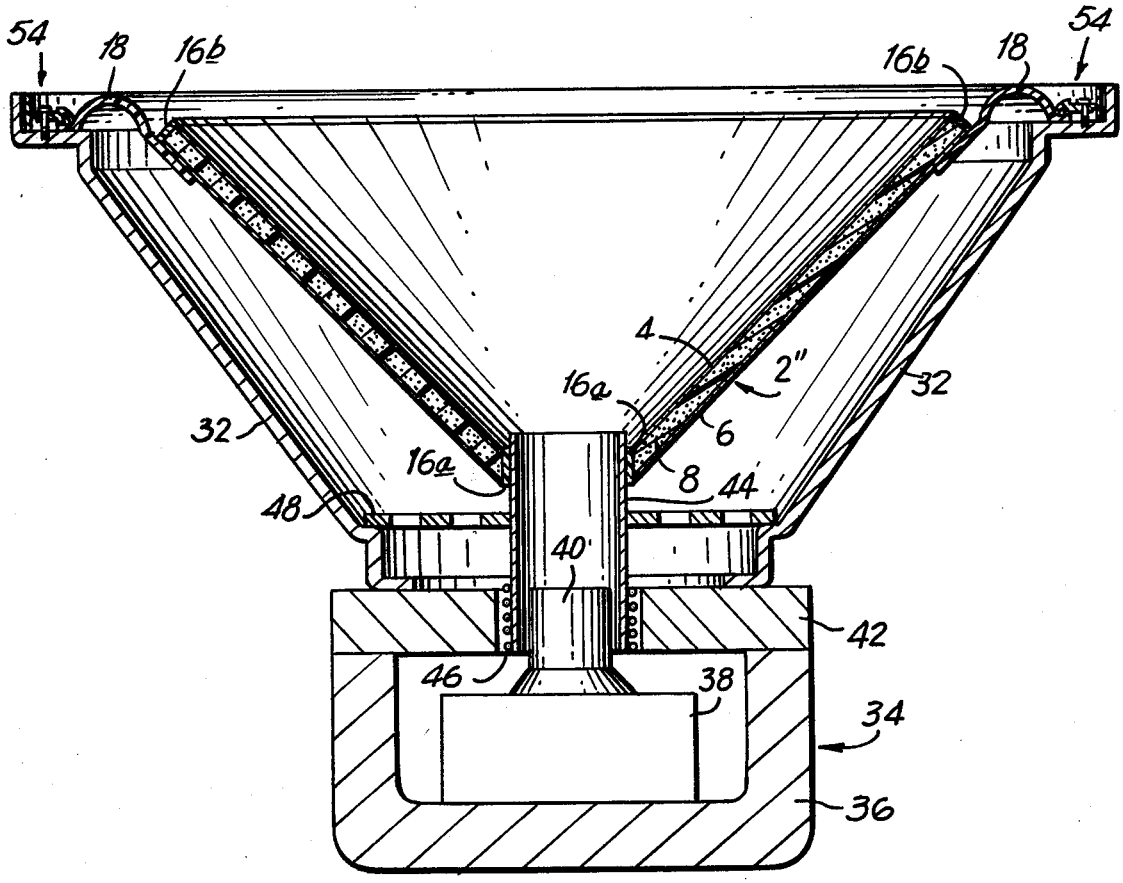
FIG. 8 is a cross-sectional view of a loudspeaker including still another embodiment of a diaphragm in accordance with the present invention.

It is to be noted that although the diaphragms 2 and 2' according to the present invention have been shown in a substantially flat box-like configuration, diaphragms according to the present invention are not limited to such shape. For example, as shown in FIG. 8, diaphragm 2'' according to the present invention may be of a frusto-conical configuration with two strip-like edging members **16*a* and 16*b* being attached to the inner and outer edge portions, respectively, of diaphragm 2''. In the case of the frusto-conical diaphragm 2'' according to this invention, the core 8'' thereof may be of a styrene foam material, as illustrated, or of an aluminum honeycomb structure, as in the case of diaphragm 2**.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A diaphragm for a loudspeaker comprising:

first and second sheet members;

a core member sandwiched between said sheet members and secured thereto, said core member having peripheral edge portions extending between edges of said sheet members and at which said core member is of relatively low strength; and a strip-like edging member secured to said peripheral edge portions of the core member and to said edges of the sheet members for increasing the rigidity of the diaphragm at its periphery and preventing unwanted vibrations thereat.

2. A diaphragm according to claim 1; wherein said core member is in the form of a honeycomb structure.

3. A diaphragm according to claim 1; wherein said core member is of a styrene foam material.

4. A diaphragm according to claim 1; wherein said sheet members are of planar configuration.

5. A diaphragm according to claim 1; wherein said sheet members are of frusto-conical configuration.

6. A diaphragm according to claim 1; wherein a damper member for movably securing said diaphragm to a loudspeaker frame is secured to the diaphragm adjacent said strip-like edging member.

7. A diaphragm according to claim 1; wherein said strip-like edging member is of a thermosetting resin material.

8. In a loudspeaker which comprises a loudspeaker frame, a diaphragm movably secured to said frame and including first and second sheet members and a core member sandwiched between said sheet members and secured thereto, and means for vibrating said diaphragm in accordance with a varying electrical signal supplied thereto;

the improvement comprising, as a part of said diaphragm, a strip-like edging member secured to edges of said sheet members and to peripheral edge portions of said core member extending between said edges for increasing the rigidity of the diaphragm at its periphery and preventing unwanted vibrations thereat.

9. A loudspeaker according to claim 8; including a damper member for movably securing said diaphragm to said frame.

10. A loudspeaker according to claim 9; wherein said damper member includes a first section adapted to be secured to a frame, a second section adapted to be secured to said diaphragm, and a flexible connecting section extending between said first and second sections.

11. A loudspeaker according to claim 10; including damper securing means for securing said damper member to said frame, said damper securing means including a pressure member having a first portion adapted to be supported by said frame; a second portion adapted to press said first section of said damper member against said frame and a connecting portion extending between said first and second portions of the pressure member, and screw means engageable with said connecting portion of the pressure member and threadably engaging said frame for causing said second portion of the pressure member to clamp said first section of the damper member against said frame.

* * * * *